US006892423B2

(12) United States Patent
Cheal et al.

(10) Patent No.: US 6,892,423 B2
(45) Date of Patent: May 17, 2005

(54) CAM-ASSISTED LID HINGE

(75) Inventors: Jonathan Paul Anthony Cheal, Staffordshire (GB); Andrew Proffitt, Wolverhampton (GB)

(73) Assignee: ITW Limited, Swansea (GB)

( * ) Notice: Subject to any disclaimer, the term of this patent is extended or adjusted under 35 U.S.C. 154(b) by 0 days.

(21) Appl. No.: 10/350,091

(22) Filed: Jan. 24, 2003

(65) Prior Publication Data

US 2003/0140454 A1 Jul. 31, 2003

(30) Foreign Application Priority Data

Jan. 25, 2002 (GB) ..... 0201660

(51) Int. Cl.[7] ..... E05F 1/08

(52) U.S. Cl. ..... 16/289; 16/286; 16/370; 180/69.21

(58) Field of Search ..... 16/289, 282, 284, 16/286–288, 308, 370, 311, 312; 296/76, 146.4, 146.8, 107.08; 49/386, 344–346; 180/69.2, 69.21

(56) References Cited

U.S. PATENT DOCUMENTS

| | | | | | |
|---|---|---|---|---|---|
| 3,351,975 | A | * | 11/1967 | Koji | 16/288 |
| 3,747,271 | A | * | 7/1973 | Adamski | 49/340 |
| 4,012,807 | A | * | 3/1977 | Kern | 16/288 |
| 4,223,420 | A | * | 9/1980 | Yukimoto et al. | 16/288 |
| 4,580,315 | A | * | 4/1986 | Beckwith | 16/308 |
| 4,587,760 | A | * | 5/1986 | Brissette | 49/252 |
| 5,339,494 | A | * | 8/1994 | Esau et al. | 16/294 |
| 5,435,406 | A | * | 7/1995 | Gaffoglio et al. | 180/69.21 |
| 5,544,388 | A | * | 8/1996 | Chiura | 16/375 |
| 5,557,829 | A | * | 9/1996 | Schoen et al. | 16/375 |
| 6,230,364 | B1 | * | 5/2001 | Cheal | 16/289 |
| 6,367,123 | B1 | * | 4/2002 | Cheal et al. | 16/370 |
| 6,618,904 | B1 | * | 9/2003 | Nagy | 16/370 |
| 2003/0217436 | A1 | * | 11/2003 | Hashim et al. | 16/286 |

FOREIGN PATENT DOCUMENTS

| | | | | | |
|---|---|---|---|---|---|
| DE | 2345453 | A | * | 3/1975 | B62D/25/12 |
| DE | 29709219 | U1 | * | 9/1998 | E05F/1/10 |
| DE | 19731507 | | | 1/1999 | |
| EP | 530494 | A1 | * | 3/1993 | E05C/17/04 |
| EP | 0808982 | | | 11/1997 | |
| JP | 11022278 | A | * | 1/1999 | E05D/11/10 |
| JP | 2001355373 | A | * | 12/2001 | E05D/15/40 |

* cited by examiner

*Primary Examiner*—Chuck Y. Mah
(74) *Attorney, Agent, or Firm*—Lowe Hauptman Gilman & Berner, LLP

(57) ABSTRACT

A hinge for a vehicle lid includes a main biasing element operable to urge the hinge into an open position, and a mechanism for assisting the initial opening of the hinge from a closed position. The mechanism includes a rotary cam engagable with another portion of the hinge to provide assistance, and a further biasing element which acts on the cam to rotate it relative to the other portion of the hinge. A lifting aid includes a main biasing element for attachment between a lid and a body, which lid is pivotally moveable towards and away from the body. The main biasing element is operable to urge the lid from a closed position relative to the body to an open position. The lifting aid further has a cam attachable to the body for relative rotation thereto and a further biasing element for attachment between the body and the cam and operable to rotate the cam relative to the body and lid. The cam is operable to assist the initial opening of the lid.

25 Claims, 2 Drawing Sheets

CAM-ASSISTED LID HINGE

FIELD OF THE INVENTION

This invention relates to cam-assisted vehicle lid hinges, in particular cam-assisted four-link vehicle lid hinges for car boot lids.

BACKGROUND TO THE INVENTION

It is increasingly common in the automotive industry to attach boot lids to car bodies using a pair of four-link hinges, each hinge comprising a body link and a lid link and the body and lid links being joined by long and short links. When the boot lid is closed the hinges collapse into the shallow gutters on each side of the boot between the boot lid and the external surface of the car body.

Such four-link hinges have the advantage, over conventional swan-neck hinges, that they do not intrude into the boot space when the boot lid is closed.

Assistance in opening the boot lid is usually provided by a gas strut acting on each hinge, and since it is undesirable for the struts to intrude into the boot space, it is necessary for them also to be located in the shallow gutters. However, the almost horizontal attitude of the struts when the lid is closed results in the struts providing a poor mechanical advantage, and therefore little assistance during the initial opening of the lid.

Various mechanisms have been proposed to assist the initial opening of such hinges, but to the best knowledge of the applicant, no mechanism to date has been operable to open the hinge to a greater extent than approximately 20° of rotation of the lid link relative to a closed position. It is believed that the minimum extent to which the hinge must be opened for the gas strut to be operable to open the hinge fully is approximately 35° of rotation of the lid link relative to the closed position.

SUMMARY OF THE INVENTION

According to the invention there is provided a hinge for a vehicle lid, the hinge comprising a main biasing means, for example a gas strut, operable to urge the hinge into an open position, and a mechanism for assisting the initial opening of the hinge from a closed position, the mechanism comprising a rotary cam engageable with another portion of the hinge to provide said assistance, and further biasing means which acts on the cam to rotate it relative to said other portion of the hinge.

Thus the invention provides a hinge for a vehicle lid having a mechanism for assisting the initial opening of the hinge that is operable to open the hinge to the minimum extent necessary to ensure that the main biasing means is operable to open the hinge to its full extent.

Preferably the cam is pivotally attached to the hinge.

Preferably the hinge is a four-link hinge.

Preferably the hinge comprises a body link for attaching to a vehicle body, a lid link for attaching to a vehicle lid, short and long links joining the body and lid links, and the main biasing means comprises a gas strut attached between the body and lid links.

Preferably the cam is pivotally attached to the long link and engageable with the lid link.

The lid link may advantageously include a cam follower for engagement with the cam.

Preferably the cam engages with the cam follower when the hinge is in the closed position and during the initial opening of the hinge from the closed position.

The further biasing means may advantageously comprise a mechanical spring.

Preferably the further biasing means comprises a helical tension spring.

The further biasing means may advantageously be attached between the cam and the long link.

Preferably the further biasing means is so attached to the long link and cam as to be disposed generally along the long link when the hinge is in the closed position. This allows a relatively large, powerful biasing means to be accommodated.

Preferably the location of the region of attachment of the further biasing means to the cam, and the location of the region of engagement of the cam with the other portion of the hinge, relative to the center of rotation of the cam, is such that the force applied by the cam to the other portion of the hinge is greater than the force applied to the cam by the further biasing means.

The lid link may advantageously be adapted for attachment to a boot lid of a car, and the body link may advantageously be adapted for attachment to the body of a car.

Although the hinge is particularly suited to a car boot lid, it may equally be applied to a bonnet of a car. Furthermore, the hinge may be used in other applications outside the automotive industry, wherever assistance in lifting a heavy lid is required.

The invention also resides in a hinge when fitted to a lid and body, for example of a vehicle.

According to a second aspect of the invention there is provided a lifting aid comprising a main biasing means for attachment between a lid and a body, which lid is pivotally moveable towards and away from the body, the main biasing means being operable to urge the lid from a closed position relative to the body to an open position, the lifting aid further comprising cam means attachable to the body for rotation relative thereto and further biasing means for attachment between the body and the cam means and operable to rotate the cam means relative to the body and lid, the cam means being operable to assist the initial opening of the lid.

BRIEF DESCRIPTION OF THE DRAWINGS

The invention will now be described by way of an example and with reference to the accompanying drawings, in which.

DETAILED DESCRIPTION OF EMBODIMENTS

Figure 1:
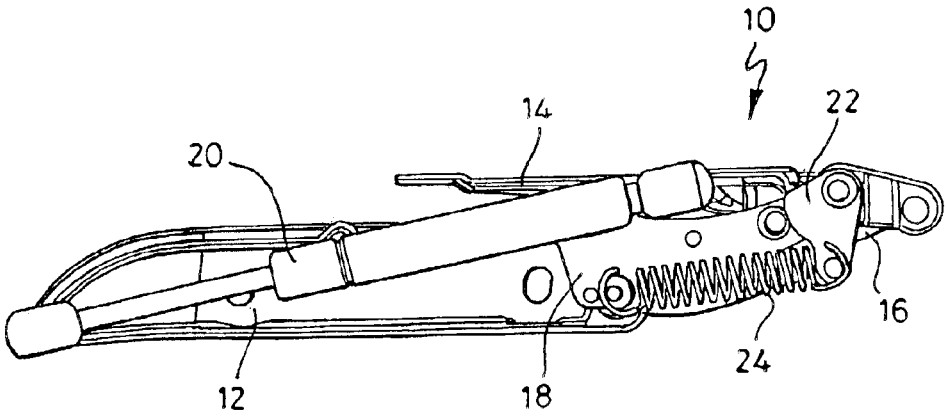
FIG. 1 is a side view of a four-link hinge in accordance with the invention, the hinge being shown in a closed position.

Referring to FIG. 1, a four-link hinge 10 for attaching a lid to a body of a vehicle comprises a body link 12 for attachment to the body, a lid link 14 for attachment to the lid, a short link 16 and a long link 18, both the short and long links being pivotally attached to the body and lid links, a gas strut 20 attached between the body and lid links, a rotary cam 22 pivotally attached to the long and lid links and a helical tension spring 24 attached between the long link 18 and the cam 22.

Figure 2:
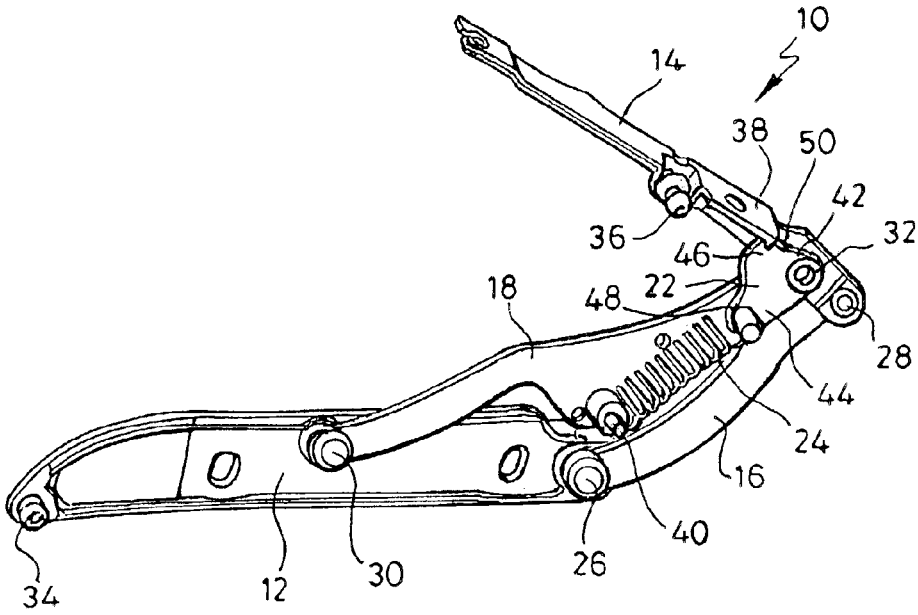
FIG. 2 is a perspective view of the hinge in a partially open position.

Referring to FIG. 2, which shows the hinge 10 of FIG. 1 in a partially open position with the gas strut 20 removed for illustrative purposes, the short link 16 is attached at a first end by a pivot 26 to a first end of the body link 12, and at a second end by a pivot 28 to a first end of the lid link 14. The long link 18 is attached at a first end by a pivot 30 to a middle portion of the body link 12, and at a second end by a pivot 32 to a portion of the lid link between the first end and a middle portion thereof. The cam 22 is attached by the pivot 32 to the lid link 14 and long link 18.

The body link 12 has a ball-ended spindle 34 at a second end for attachment to a first end of the gas strut (not shown in FIG. 2). The lid link 14 has a ball-ended spindle 36 at the middle portion for attachment to a second end of the gas strut. A cam follower 38 in the form of an angled tab projects from the middle portion of the lid link 14. The long link 18 has a stud 40 at a middle portion.

The cam 22 is lobulate, having first, second and third lobes 42, 44 and 46, respectively. The pivot 32 passes through the first lobe 42. The second lobe 44 is provided with a stud 48. The edge of the third lobe 46 forms a cam surface 50 that engages with the cam follower 38 when the hinge is in the closed position and during the initial opening of the hinge from the closed position. The spring 24 is attached between the studs 40 and 48. The distance from the stud 48, on which the spring 24 acts, to the pivot 32 is greater than the distance from the cam surface 50 to the pivot 32, such that when the cam is rotated by the spring 24, a mechanical advantage is obtained at the cam surface 50.

It will be appreciated from FIGS. 1 and 2 that the initial opening of the hinge from the closed position involves a both a linear displacement and a rotation of the lid link 14 relative to the body link 12. However, in the closed position the gas strut lies along the body and lid links, and the component of the force exerted by the gas strut tending to open the hinge is relatively small. Moreover, the ball-ended spindle 36 of the lid link through which the gas strut acts is relatively close to the pivots 28 and 32, further reducing the efficacy of the gas strut in opening the hinge.

Figure 3:
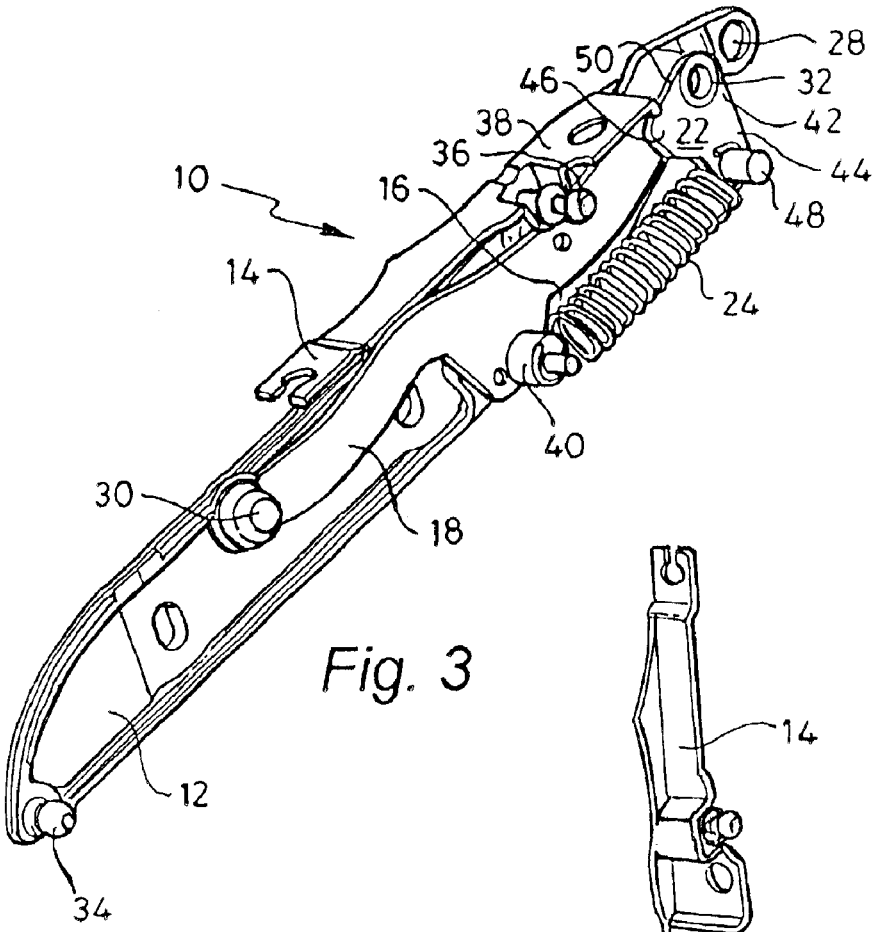
FIG. 3 is a perspective view of the hinge in the closed position.

Referring to FIG. 3, which shows the hinge 10 again in a closed position, the cam surface 50 is engaged with the cam follower 38 as a result of the force exerted by the spring 24 on the studs 40 and 48. When the hinge is released, for example as by releasing a lid catch, the force exerted by the spring 24 on the studs 48 and 40 rotates the cam 22 about the pivot 32 relative to the lid link 14, the engagement of the cam surface 50 and the cam follower 38 causing the lid, short and long links to move relative to the body link, thus opening the hinge.

Figure 4:
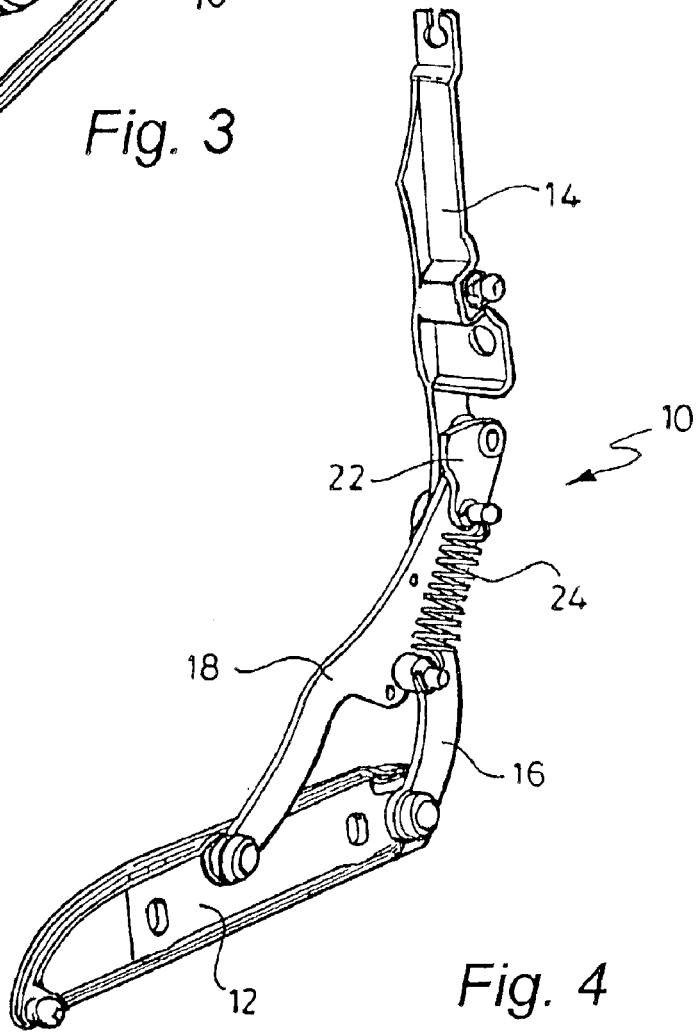
FIG. 4 is a perspective view of the hinge in a fully open position.

The hinge continues to open until the cam has rotated to the point at which the line of action of the spring 24 passes through the pivot 32. This is the situation shown in FIG. 2. When the hinge has opened to the extent that the cam has ceased to act, by which time the lid has moved through approximately 35° from the closed position, the line of action of the gas strut (not shown in FIG. 2) is such that the gas strut is operable to open the hinge to its full extent. The hinge is shown open to its full extent in FIG. 4.

In this way the hinge is operable to open the lid from a closed position to a fully open position upon the release of the lid catch. This has not been possible with previous hinge mechanisms.

Moreover, by slight alterations to the profile of the cam surface and/or length of the cam follower, the force with which, and the extent of opening of the hinge over which, the cam acts can be adjusted.

This involves a compromise; increasing the extent of opening of the hinge over which the cam acts by increasing the distance between the cam surface 50 and the pivot 32 results in a decrease in the mechanical advantage provided by the cam. Conversely, increasing the mechanical advantage provided by the cam results in a decrease in the extent of opening of the hinge over which the cam acts.

In another embodiment a lid takes the place of the lid link and a vehicle body takes the place of the body link, the lid and body being joined by short and long links, a gas strut being attached between the body and lid, the cam being pivotally attached to the body link and a helical tension spring attached between the body and cam causing the cam to engage with a cam follower on the lid to assist the initial opening of the lid from a closed position.

It will be apparent that the above description relates only to two embodiments of the invention, and that the invention encompasses other embodiments as defined by the foregoing summary of the invention.

What is claimed is:

1. A hinge for a vehicle lid, the hinge comprising:

a first hinge part;

a second hinge part moveable relative to said first hinge part between a closed position and an open position;

main biasing means directly attached to said first and second hinge parts for urging said second hinge part into the open position; and a mechanism for assisting the initial movement of the second hinge part from the closed position, the mechanism comprising:

a rotary cam being rotatable about an axis and having a first portion engageable with the second hinge part to provide said assistance; and auxiliary biasing means acting on a second portion of the cam for rotating said cam relative to said second hinge part, thereby causing, via said engagement, said second hinge part to move;

wherein said second portion of the cam is farther from said axis than said first portion of the cam, whereby a force applied by the cam to the second hinge part is greater than a force applied to the cam by said auxiliary biasing means.

2. The hinge according to claim 1, wherein the hinge further comprises first and second links, each being pivotally attached to both said first and second hinge parts, to define a four-link hinge.

3. The hinge according to claim 2, wherein said first hinge part is a body link adapted to be attached to a vehicle body, said second hinge part is a lid link adapted to be attached to a vehicle lid, said first and second links are short and long links, respectively, and the main biasing means comprises a gas strut attached between the body and lid links.

4. The hinge according to claim 3, wherein the cam is pivotally attached to the long link and engageable with the lid link.

5. The hinge according to claim 3, wherein the lid link includes a cam follower for engagement with the cam.

6. The hinge according to claim 5, wherein the cam engages with the cam follower only when the lid link is in the closed position and during the initial opening of the lid link from the closed position.

7. The hinge according to claim 6, wherein the auxiliary biasing means comprises a mechanical spring.

8. The hinge according to claim 7, wherein the auxiliary biasing means comprises a helical tension spring.

9. The hinge according to claim 3, wherein the auxiliary biasing means is attached between the cam and the long link.

10. The hinge according to claim 9, wherein the auxiliary biasing means is so attached to the long link and the cam as to be disposed generally along the long link when the lid link is in the closed position.

11. The hinge according to claim 3, wherein the lid link is adapted to be attached to a boot lid of a car, and the body link is adapted to be attached to the body of the car.

12. A vehicle, comprising a body and a lid respectively defining the first and second hinge parts of the hinge in accordance with claim 1.

13. The hinge according to claim 1, wherein the first portion of said cam disengages from the second hinge part once the latter has reached a predetermined intermediate position between the closed and open positions.

14. The hinge according to claim 13, wherein, in said intermediate position, a line of action of a biasing force of said auxiliary biasing means extends through said axis.

15. A hinge, comprising:

a first hinge part;

a second hinge part moveable relative to said first hinge part between a first position and a second position via a third, intermediate position between said first and second positions;

a first spring element being attached to both said first and second hinge parts and urging said second hinge part into the second position;

a link pivotally attached to both said first and second hinge parts;

a moving member being moveably attached to said link and engageable with the second hinge part when said second hinge part is at a location between said first and third positions, whereby a movement of said member in a predetermined direction will cause said second hinge part to move from the first to the third positions; and a second spring element acting on said moving member and urging said member to move in said predetermined direction.

16. The hinge according to claim 15, wherein said member disengages from the second hinge part when said second hinge part is at a location between said second and third positions.

17. The hinge according to claim 15, wherein said member is a rotary element attached to said link to be pivotable about an axis, said rotary element including:

a first portion engageable with the second hinge part when said second hinge part is at a location between said first and third positions; and a second portion upon which said second spring element acts to urge said rotary element to rotate in said predetermined direction.

18. The hinge according to claim 17, wherein said first portion is closer to said axis than said second portion, whereby a force applied by the rotary element to the second hinge part is greater than a force applied to the rotary element by said second spring element.

19. The hinge according to claim 17, wherein, in said third position, a line of action of a biasing force of said second spring element extends through said axis.

20. The hinge according to claim 15, wherein the hinge further comprises another link which is shorter than said link and pivotally attached to both said first and second hinge parts.

21. The hinge according to claim 20, wherein the first spring element comprises a gas strut and said second spring element comprises a helical spring.

22. The hinge according to claim 17, wherein said rotary element and said link are pivotally attached the said second hinge part by a common pivot.

23. A hinge, comprising:

a first hinge part;

a second hinge part moveable relative to said first hinge part between a first position and a second position via a third, intermediate position between said first and second positions;

a gas strut being attached to both said first and second hinge parts and urging said second hinge part into the second position;

a rotary element rotatable about an axis and having a first portion engageable with the second hinge part when said second hinge part is at a location between said first and third positions, whereby a rotational movement of said rotary element in a predetermined direction will cause said second hinge part to move from the first to the third positions; and a spring element acting on a second portion of said rotary element and urging said rotary element to rotate in said predetermined direction;

wherein said first portion is closer to said axis than said second portion, whereby a force applied by the rotary element to the second hinge part is greater than a force applied to the rotary element by said spring element.

24. The hinge according to claim 23, wherein the first portion of said rotary element disengages from the second hinge part when paid second hinge part is at a location between said second and third positions.

25. The hinge according to claim 23, further comprising a link pivotally attached to both said first and second hinge parts, wherein the spring element has first and second opposite ends attached to said link and said rotary element, respectively.

* * * * *